US006869325B1

(12) United States Patent
Askestad

(10) Patent No.: US 6,869,325 B1
(45) Date of Patent: Mar. 22, 2005

(54) ROTATING TOWER SYSTEM FOR TRANSFERRING HYDROCARBONS TO A SHIP

(75) Inventor: Sigmund Askestad, Saetre (NO)

(73) Assignee: Statoil ASA, Stavanger (NO)

( * ) Notice: Subject to any disclaimer, the term of this patent is extended or adjusted under 35 U.S.C. 154(b) by 0 days.

(21) Appl. No.: 10/169,976

(22) PCT Filed: Jan. 13, 2000

(86) PCT No.: PCT/NO00/00012

§ 371 (c)(1),
(2), (4) Date: Nov. 20, 2002

(87) PCT Pub. No.: WO01/51347

PCT Pub. Date: Jul. 19, 2001

(51) Int. Cl.[7] ..... B63B 22/02; E02B 17/00

(52) U.S. Cl. ..... 441/5; 114/230.12; 405/202; 166/355

(58) Field of Search ..... 144/230.1, 230.12, 144/293; 441/3–5; 166/352, 354, 355; 405/202; 384/107–113, 145, 192–196, 206, 226–228

(56) References Cited

U.S. PATENT DOCUMENTS

| | | | | | |
|---|---|---|---|---|---|
| 3,791,442 | A | * | 2/1974 | Watkins | 166/352 |
| 4,566,824 | A | * | 1/1986 | Minier et al. | 405/202 |
| 4,701,143 | A | | 10/1987 | Key et al. | |
| 4,955,310 | A | * | 9/1990 | Pollack | 114/230.12 |
| 5,316,509 | A | * | 5/1994 | Boatman et al. | 441/3 |
| 5,363,789 | A | | 11/1994 | Laurie et al. | |
| 5,395,183 | A | * | 3/1995 | Watkins | 405/195.1 |
| 5,515,804 | A | | 5/1996 | Pollack | |
| 5,564,957 | A | * | 10/1996 | Breivik et al. | 441/5 |
| 5,782,197 | A | * | 7/1998 | Pollack | 114/230.12 |
| 5,839,387 | A | * | 11/1998 | Myklebust | 114/230.12 |
| 6,477,974 | B2 | * | 11/2002 | Hobdy | 114/230.12 |

FOREIGN PATENT DOCUMENTS

| | | |
|---|---|---|
| EP | 0656293 | 6/1995 |
| EP | 0884238 | 12/1998 |
| GB | 2046199 | 11/1980 |
| NO | 1997 0071 | 1/1997 |
| WO | 9324733 | 12/1993 |

* cited by examiner

*Primary Examiner*—S. Joseph Morano
*Assistant Examiner*—Ajay Vasudeva
(74) *Attorney, Agent, or Firm*—Millen White Zelano & Branigan, P.C.

(57) ABSTRACT

A rotating tower system for transferring hydrocarbons to a ship, comprising a transfer structure extending from the bottom (3) of the ship (1) to the deck (4) thereof, the structure at its lower end being connected to a number of risers (22) and to anchor lines (9) for anchoring of the ship (1), and at its upper end being connected to a rotatable coupling device (20) on the deck of the ship (1). The structure comprises a lower and an upper rotating body (5, 6) which are independently mounted in relation to the ship (1) and are connected to each other via an intermediate connecting unit (7). The lower (5) and possibly also the upper (6) rotating body in its central region is connected to the adjacent end of the connecting unit (7) via an articulated bearing connection (30, 31) allowing occurring angular deviations and possibly absorbing radial and/or axial forces.

10 Claims, 8 Drawing Sheets

ROTATING TOWER SYSTEM FOR TRANSFERRING HYDROCARBONS TO A SHIP

The invention relates to a rotating tower system for transferring hydrocarbons to a ship, comprising a transfer structure extending from the bottom of the ship to the deck thereof, the structure at its lower end being connected to a number of risers and to anchor lines for anchoring of the ship, and at its upper end being to connected to a rotatable coupling device on the deck of the ship, the structure comprising a lower and an upper rotating body which are independently mounted in relation to the ship and are connected to each other via an intermediate connecting unit.

The previously known rotating tower systems of the above-mentioned type comprise a rotating tower or turret forming a continuous rigid cylinder extending essentially over the full depth or height of the ship, i.e. essentially from the bottom to the deck of the ship. It is known to arrange these rotating tower systems on the outer side of the ship, for example in the bow or the stern, or alternatively internally of the ship. The continuous rigid rotating tower in the known systems extends from a lower chain table and a lower bearing system up to an upper bearing system with a fluid-transferring swivel device. The rotating tower constitutes a relatively heavy structure requiring strong cranes for assembly, and the rigidity of the rotating tower entails severe demands to alignment of the lower and upper bearing systems, something which entails increased costs both in manufacture and installation.

The object of the invention is to provide a rotating tower system which is divided into smaller structural parts having a reduced size and weight and giving the possibility of a large extent of prefabrication, and wherein there is simultaneously achieved reduced demands to alignment of the bearing means.

For the achievement of the above-mentioned object there is provided a rotating tower system of the introductorily stated type which, according to the invention, is characterized in that the lower rotating body in its central region is connected to a lower end of the connecting unit via an articulated bearing connection allowing occurring angular deviations and possibly also absorbing radial and/or axial forces.

In an advantageous embodiment also the upper rotating body in its central region is connected to an upper end of the connecting unit via an articulated bearing connection allowing occurring angular deviations and possibly also absorbing radial and/or axial forces.

The connecting unit of the system suitably may be a hollow column giving room for risers and guide pipes for control cables (umbilicals).

By dividing the rotating tower system in the stated manner, a number of advantages are achieved.

Firstly, the height/size of the rotating tower is reduced, so that lifting weights and lifting heights of the installation are reduced. The solution also gives the possibility of a large extent of prefabrication, and of handling by means of the own cranes of the shipyard, without having to call in crane vessels.

Secondly, the demands to alignment of the upper and lower bearing means are reduced in that the intermediate column can absorb alignment obliquities which may arise during operation as a result of changes in load states and temperature conditions.

Further, the risers can be terminated down in the rotating body, and the safety of the system may be increased by also placing safety or shut-off valves in the rotating io body. The rotating body can allow a very large angle of the guide pipes for terminating the risers. This is very relevant when using rigid risers in regions having a small water depth.

BRIEF DESCRIPTION OF THE DRAWINGS

The invention will be further described below in connection with exemplary embodiments with reference to the drawings, wherein

In the drawings, corresponding parts and elements in the different embodiments are designated by similar reference numerals (possibly provided with a prime).

FIGS. 1 and 2 show a side view and a plan view, respectively, of a ship 1 wherein a turret or rotating tower system 2 according to the invention is arranged on the external side of the ship, in the illustrated case more specifically on the starboard side at the forward end of the ship. The system is constructed for transferring hydrocarbons (oil or gas) from a subsea reservoir via marine risers up to a rotating coupling device (swivel) on the deck of the ship, and therefrom to tanks on the ship. The system comprises a transfer structure extending from the bottom 3 of the ship 1 up to the deck 4 thereof, and which is divided into a lower turret or rotating body 5 and an upper rotating body in the form of a rotating table 6 which is rotationally fixedly connected to each other via an intermediate connecting unit 7. At its lower end the lower rotating body 5 is connected to a so-called chain table 8 to which there are fastened a number of bottom-anchored anchor lines 9 for anchoring of the ship.

FIG. 3 shows an enlarged side view of the rotating tower system of FIGS. 1–2, wherein the system is shown vertically sectioned in a section at right angles to the longitudinal axis of the ship 1.

Figure 1:
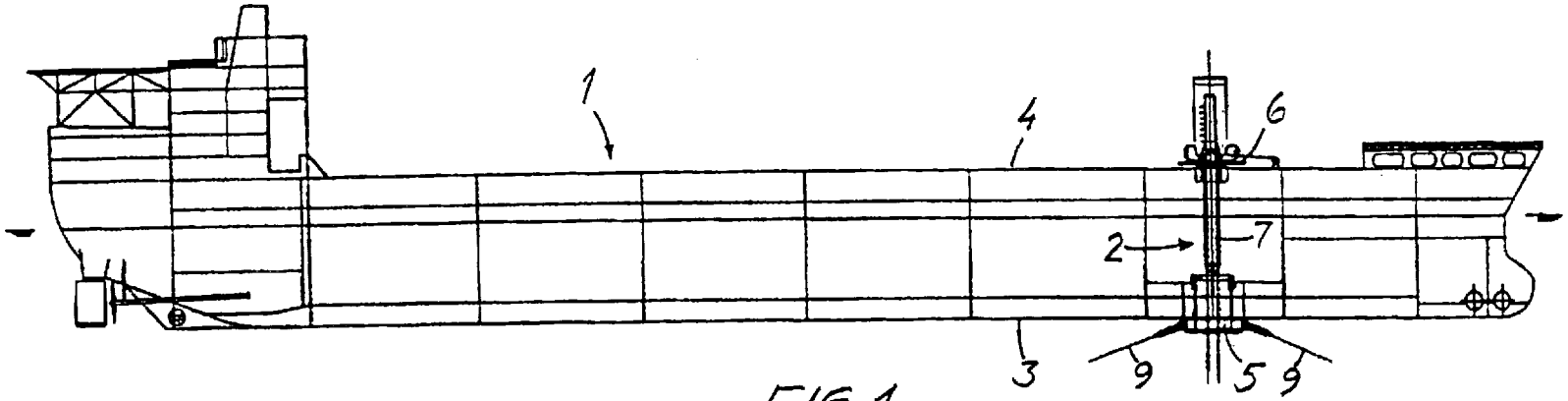
FIGS 1 and 2 show a side view and a plan view, respectively, of a ship wherein a rotating tower system according to the invention is arranged on the outer side of the ship.
Figure 2:
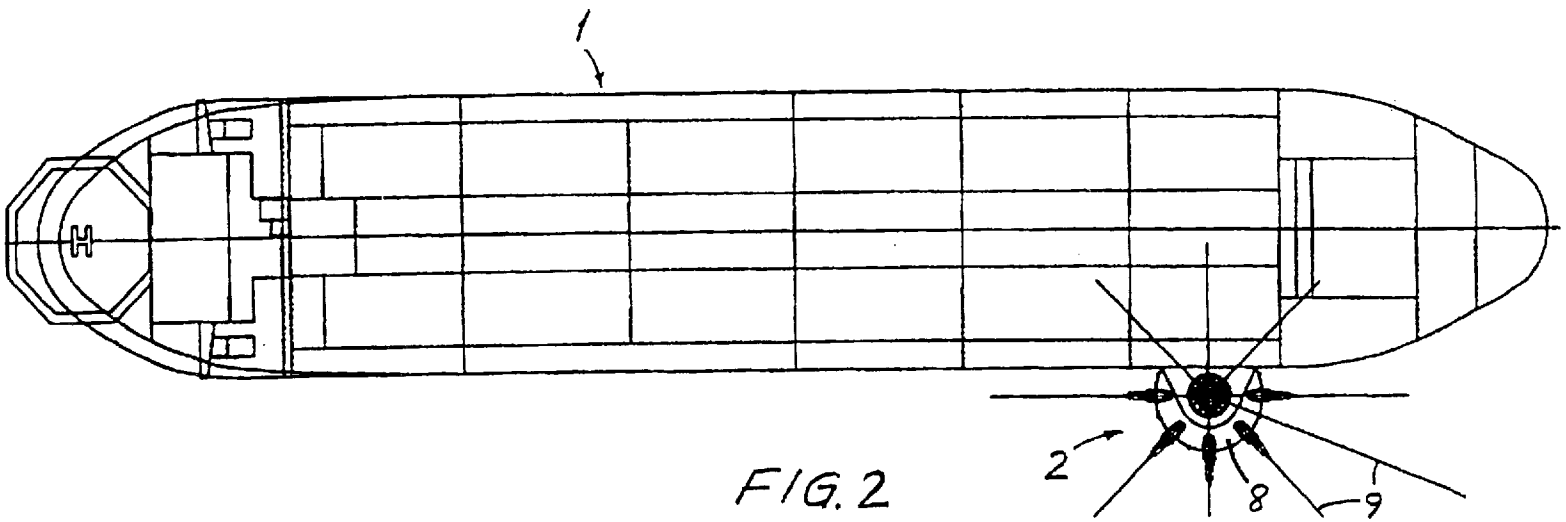

As appears, the lower rotating body 5 and the rotating table 6 are separately individually mounted in respective annular supporting structures 10 and 11, respectively, which are rigidly connected to the ship side 12 via respective, vertical and horizontal shearing plates 13 and 14 respectively 15 and 16. The vertical shearing plates 13 transfer the vertical forces from the anchoring system and the risers from the lower rotating body 5 and the supporting structure 10 to the ship side 12. The shearing plates suitably are arranged with a long connection to the ship I in order to distribute the loads as much as possible to load-absorbing structure which is already arranged in the interior of the ship. The horizontal shearing plates 14 connect the supporting structure 10 with the ship hull in order to transfer horizontal forces from the rotating body. The vertical and horizontal shearing plates 15, 16 in connection with the supporting structure 11 for the rotating table 6 function in a corresponding manner.

Figure 3:
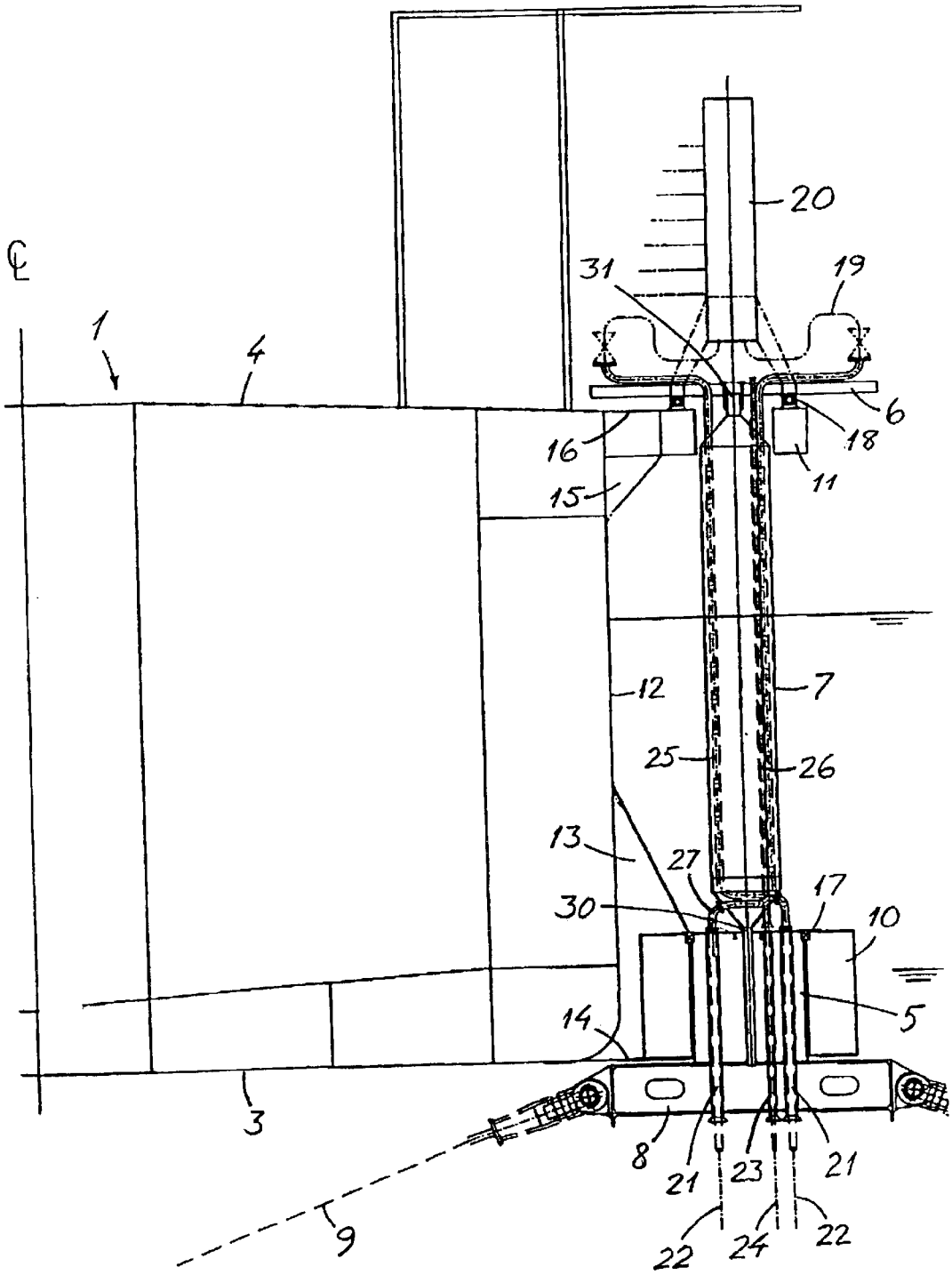
FIG. 3 shows a schematic, vertically sectioned view of the rotating tower system of FIGS. 1–2, in section at right angles to the longitudinal axis of the ship.

The lower rotating body 5 in a conventional manner is supported and mounted in the supporting structure 10 by means of a radial bearing and an axial bearing symbolised by the bearing 17 in FIG. 3. The upper rotating body or rotating table 6 is mounted in the supporting structure 11 by means of a bearing 18 and carries a transfer system in the form of a pipe system 19 and a swivel unit 20, as further described in connection with FIG. 7.

Through the chain table 8 and the rotating body 5 there are carried a number of guide pipes 21 for pulling-in of respective marine risers 22, and also one a more guide pipes 23 for pulling-in of respective umbilicals 24. The risers 22 are terminated in the rotating body 5 and possibly also provided with shut-off valves (not shown) in the rotating body.

The connecting unit 7 between the lower rotating body 5 and the rotating table 6 in the illustrated embodiment is constituted by a hollow column receiving and protecting risers and guide pipes for umbilicals against influences from the surroundings. Thus, through the column there are carried guide pipes and/or risers 25 from the terminated risers 22 in the rotating body 5 up to the pipe system 19 on the rotating table 6, and guide pipes 26 for the umbilical or umbilicals 24. The risers are carried into the column 7 via bends 27, whereas the umbilical 24 is pulled directly into the guide pipe 26 to be carried continuously without couplings up to the deck 4 where it is terminated. The guide pipe 26 is formed with a trumpet mouth at its lower end, to facilitate the pulling-in of the umbilical.

At its lower end the column 7 is connected with the rotating body 5 and the rotating table 6, respectively, via articulated bearing connections 30, 31 allowing occurring angular deviations and absorbing radial and possibly also axial forces, as further described in connection with FIGS. 5–7. One of the articulated bearing connections, preferably the uppermost, may be arranged so that it only absorbs radial forces.

Further, there are provided for means for a rotationally fixed connection between the column 7 and the rotating body 5 and the rotating table 6, respectively. Each of these means, which are not shown in the drawings, for example may consist of a bracket which is mounted on the upper and the lower end of the column and which acts against or is in suitable engagement with a corresponding holding element mounted on the top of the rotating body and on the underside of the rotating table.

Figure 4:
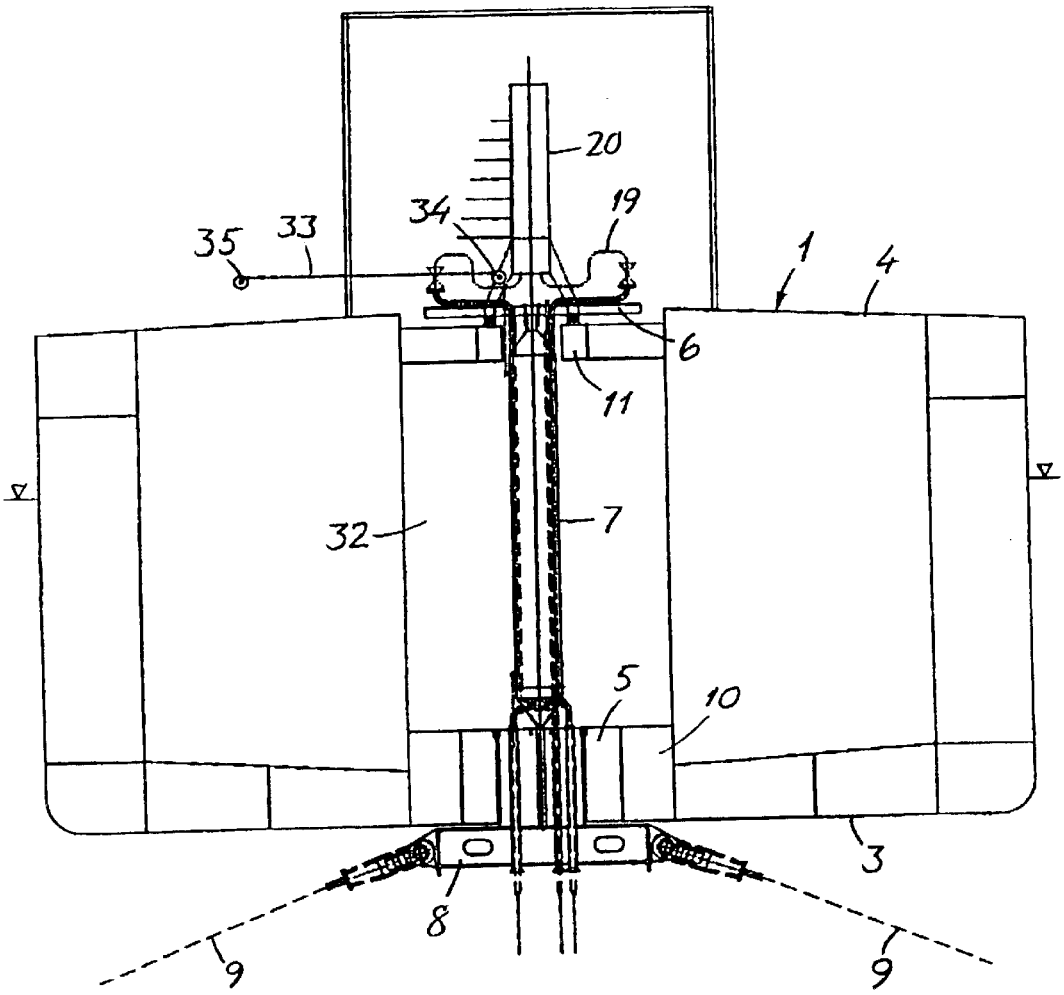
FIG. 4 shows a view similar to that of FIG. 3, but wherein the system is installed internally of the ship.

FIG. 4 shows a rotating tower system according to the invention in a view corresponding to that of FIG. 3, but wherein the system is installed internally of the ship 1, more specifically in a through-going space (moonpool) 32 extending between the bottom 3 and the deck 4 of the ship. The shown embodiment of the system corresponds to the embodiment according to FIG. 3, so that further description is superfluous. It is only to be mentioned that the figure also shows a line 33 which is carried over disks 34 and 35 to a non-illustrated winch, to be used when pulling risers into the rotating body 5.

Figure 5:
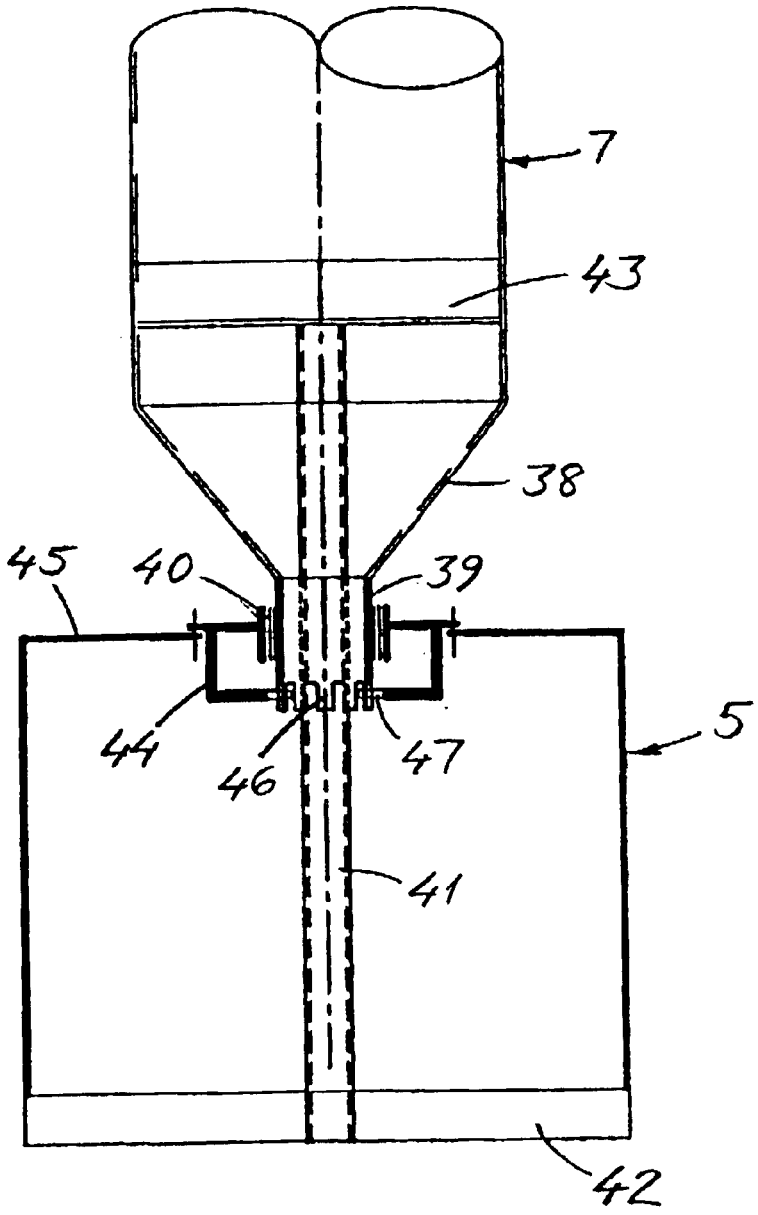
FIG. 5 shows a sectional view of an embodiment of an arrangement for the interconnection of the lower rotating body and the connecting column.

An embodiment of the arrangement for connection between the lower rotating body 5 and the connecting column 7 is shown in section in FIG. 5. As appears, the column 7 at its lower end is terminated with a conical member 38 passing into a cylindrical tube member 39 which is coupled to the rotating body 5 via a radial bearing 40. The bearing is static, and suitably is manufactured from an elastomeric material for easily absorbing relative, axial movements and angular deflections between the column 7 and the rotating body 5. An elongated structural member 41, in the shown case a slender pipe, is placed coaxially with the axis of the column 7 and concentrically with the tube member 39, so that the tube member surrounds the structural member or pipe 41 with a suitable clearance. The purpose of the clearance is to improve the flexibility in the connection between the column and the rotating body.

The slender pipe 41 extends from a base 42 arranged in the rotating body 5, and up to a horizontal supporting structure 43 arranged in the column 7 at a distance above the conical member 38. The base in the rotating body here is constituted by the bottom of the rotating body, but could possibly be arranged at a higher level in the rotating body. The purpose of the structural member 41 primarily is to provide an axially rigid connection between the rotating body 5 and the column 7, wherein the connection absorbs both upwards directed and downwards directed forces, but simultaneously is soft for allowing the above-mentioned movements and deflections.

The radial bearing 40 in the illustrated embodiment is mounted in a bearing box 44 which is suitably fixed in the rotating body, more specifically in the upper top plate or deck 45 thereof, the tube member 39 being rotationally fixedly connected with the bearing box. The rotationally fixed connection is provided in that the lower end of the tube member 39 along the periphery is formed with axially directed teeth 46 which are in engagement with complementary teeth 47 projecting inwards from a tube-member surrounding opening in the bottom of the bearing box. The illustrated arrangement represents one of several possible methods for transferring the rotating movement from the rotating body 5 to the column 7 and to the rotating table 6. At the same time as the rotating movement is transferred, there is also allowed a relative vertical movement between the teeth.

As will be understood, this solution for transfer of the rotating movement represents an alternative to the aforementioned arrangement of a column bracket and a cooperating holding element mounted on the top of the rotating body.

The purpose of the arrangement of the bearing 40 and the rotating device 46, 47 is to form a simple connection between the rotating body and the column, wherein this arrangement is allowed to be mounted on the column as part of the connecting unit of the system. Another advantage of this solution is that the bearing 40, which advantageously has snug fit in order to reduce radial movements, will be able to be mounted to the column at a workshop instead of out in a dock.

Figure 6:
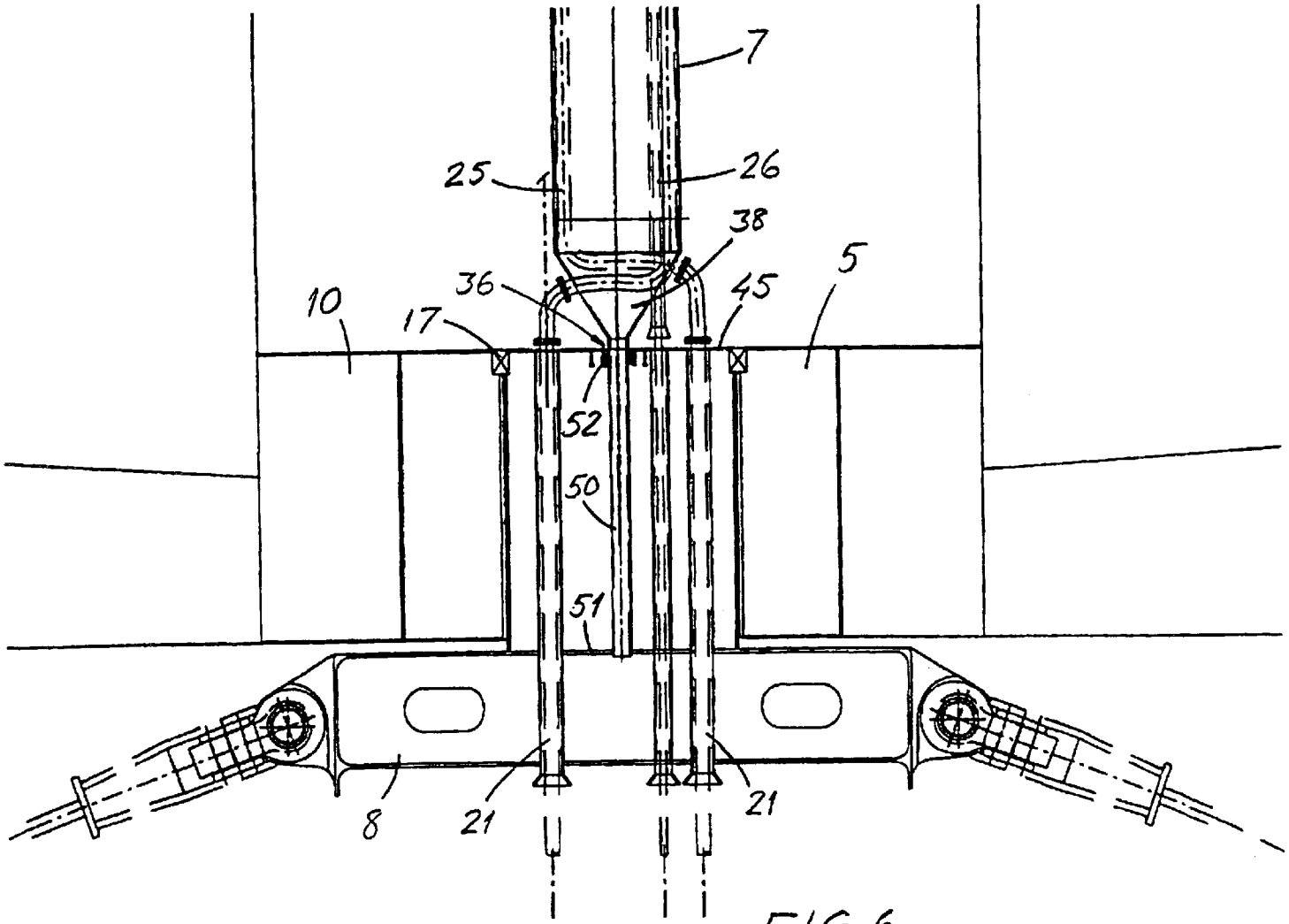
FIG. 6 shows an enlarged sectional view of the lower part of the rotating tower system of FIGS. 3 and 4.

The arrangement for interconnection between the rotating body 5 and the column 7 shown in FIGS. 3 and 4, and which is also shown schematically in the enlarged view of FIG. 6, represents a simpler and somewhat more bending-stiff connection than the embodiment according to FIG. 5. Also in this embodiment the column 7 has a conical member 38 at its lower end, but this member here passes into a slender structural member 50 in the form of a pipe extending downwards in the rotating body 5 and at the lower end being supported by a base in the rotating body, more specifically by the bottom structure 51 thereof. The pipe 50, which at its upper end forms a rigid connection with the column 7, possibly might be extended upwards in the column and at the upper end be fastened to a transverse base in the column, in a corresponding manner as in the embodiment of FIG. 5.

For radial retention of the pipe 50, this mounted at its upper end in a radial bearing 52 which is fitted in the deck 45 of the rotating body 5. Also this bearing suitably is formed from a material, e.g. an elastomer, which easily allows angular changes of the column in relation to the deck of the rotating body, but which absorbs the -horizontal shearing forces between the column 7 and the rotating body 5. Also in this embodiment the slender pipe 50 will transfer tensile as well as compressive forces between the rotating body and the column.

Figure 7:
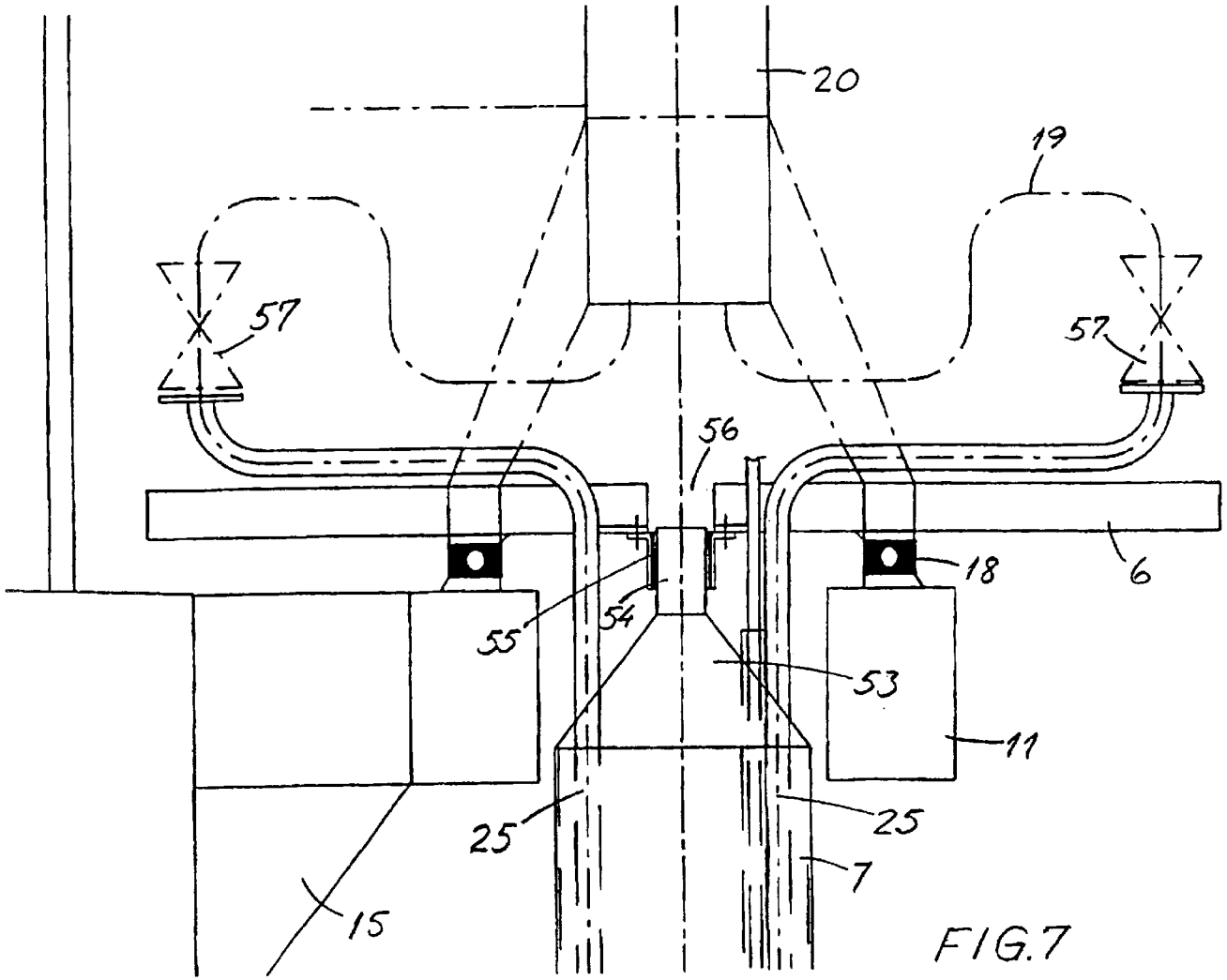
FIG. 7 shows an enlarged view of the upper part of the system of FIGS. 3 and 4.

FIG. 7 shows a sectional view of the upper part of the rotating tower system of FIGS. 3 and 4, i.e. the upper part of the column 7 and the interconnection thereof with the rotating table 6 which carries the pipe system 19 and the swivel unit 20.

As shown, the column at its upper end has a conical transition member 53 passing into a conical stud member 54. This is mounted in a radial bearing 55 which is fitted in line with a central opening 56 in the rotating table 6. The bearing 55 suitably may be formed from an elastomeric material or rubber, in a corresponding manner to that of the bearings 40 and 52. The bearing possibly may be fitted in a bearing box (not shown) in a similar manner as the bearing box 44 in FIG. 5, the bearing box then being fastened to the underside of the rotating table 6. This bearing box may be arranged in a corresponding manner to that of the bearing box 44, so that it absorbs radial forces and rotational forces, but not axial forces.

The purpose of the bearing arrangement is to transfer radial forces from the column to the rotating table, but simultaneously to be able to allow small angular deviations and small axial movements between the column 7 and the rotating table 6. It is here an advantage that the bearing 54 is placed at the same level as the bearing 18 for mounting of the rotating table on the supporting structure 11, the moments in the latter bearing then becoming substantially reduced. This is important in order to be able to use simple ball bearings. The purpose of the connection is also to form a simple sectional connection between the column section 7 with associated equipment, and the rotating table section 6 with the pipe system 19 and the swivel unit 20 fitted thereon. It will be a substantial advantage that the radial bearing 55 is fitted on the pivot 54 before shipping of the column section to the relevant shipyard or dock before the assembly with the lower rotating body 5. An additional purpose of the arrangement is to be able to adjust the upper mounting of the column after the rotating table and the supporting structure thereof having been assembled, by being able to adjust both angular direction and axial position.

As appears from the figure, the risers 25 have been carried up from the column 7 and through the rotating table 6, and are coupled to shut-off valves 57 on the upper side of the rotating table. The pipe system 19 in a conventional manner forms suitable connections between the shut-off valves 57 and that part of the swivel unit 20 which is stationary relative to the rotating table.

Figure 8:
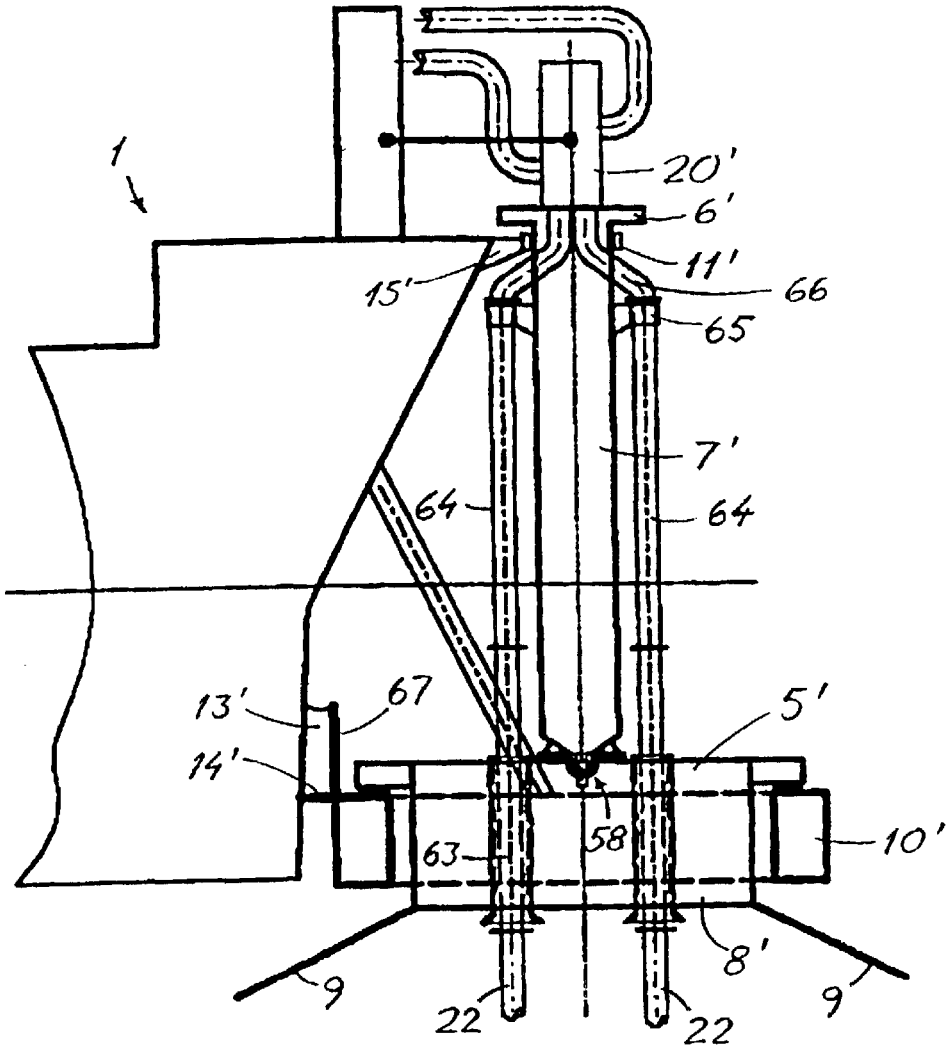
FIG. 8 shows a schematic, vertically sectioned view of an additional embodiment of a rotating tower system according to the invention.
Figure 9:
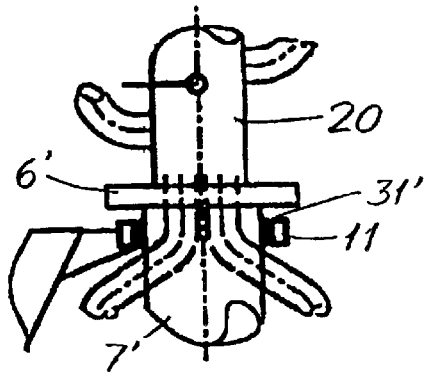
FIG. 9 shows a somewhat enlarged view of the upper part of the system of FIG. 8.
Figure 10:
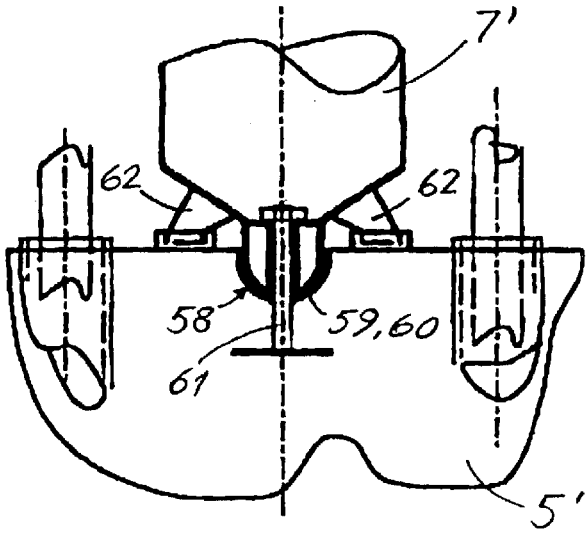
FIG. 10 shows a somewhat enlarged view of the lower part of the system of FIG. 8.

An alternative embodiment of the system according to the invention is schematically shown in FIGS. 8–10. In this embodiment the rotating table 6' is fixedly connected to the upper end of the column 7'. The bearing 31 shown in FIG. 3 between the upper part of the column 7 and the rotating table 6 has been replaced by a bearing 31' which is placed directly on the supporting structure 11'. The bearing 18 of FIG. 3, which is a combined axial and radial bearing, thereby is omitted. The bearing 31' is a radial bearing. The supporting structure 11' now becomes lighter, as it shall now only transfer radial forces from the column 7' to the ship 1. The bearing 31' also becomes lighter than the bearing 30. This solution is especially advantageous where the equipment which is to be mounted on the rotating table 6', has a small weight.

The column 7' at its lower end is mounted in a flexible, elastomerically based bearing 58 which absorbs axial and radial forces. The bearing comprises a pair of opposite, partly spherical surfaces 59, 60 arranged on the end portion of the column 7' and in the rotating body 5', respectively, and an intermediate rubber element (not shown). In the centre of the bearing there is fitted a rod 61 which absorbs possible upwards directed forces. Between the lower end of the column and the rotating body there are arranged a number of holding brackets 62 providing for torque transfer from the rotating body 5' up to the column 7' and the rotatable coupling device (the swivel unit) 20'.

In the embodiment of FIG. 8, the risers 22 are connected to rigid riser extensions 63 which are carried through the rotating body 5' and are connected to riser sections 64 fitted on the outside of the column 7'. The riser sections are suspended from hanger brackets 65 fastened to the column at the upper end thereof, and are coupled to pipe members 66 which are connected to associated pipe courses in the swivel unit 20'.

As will be understood, this embodiment results in a simpler assembly than the embodiment according to FIG. 3.

Figure 11:
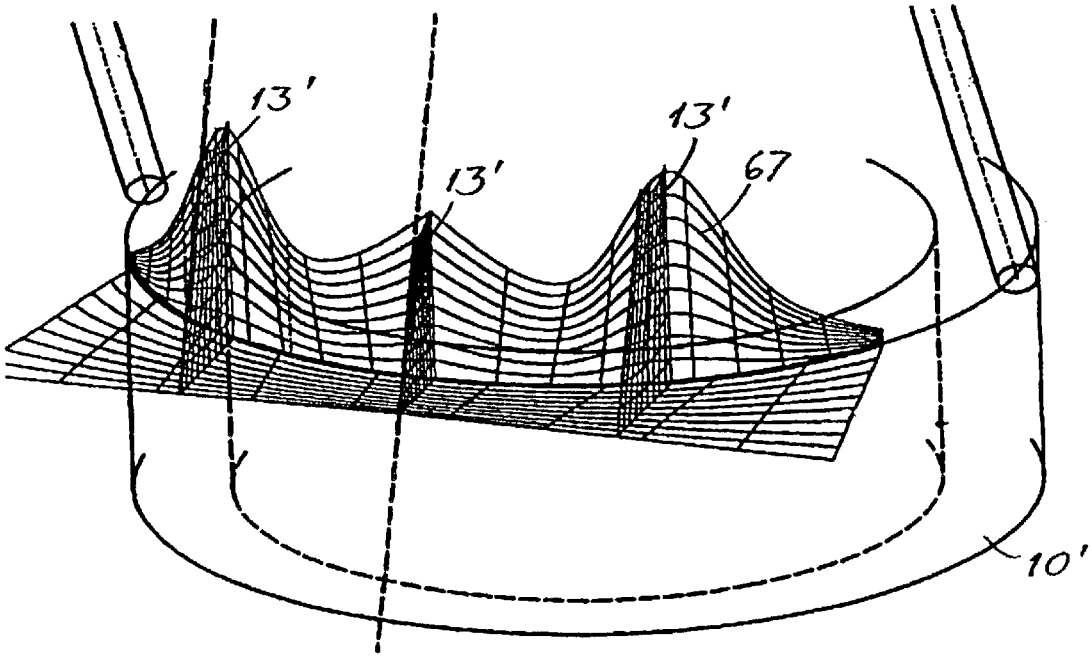
FIG. 11 shows a schematic perspective view of a segment of a lower supporting structure in the system according to the invention, and shearing plates for attachment of the supporting structure to a vessel hull.

FIG. 11 shows a perspective view of a schematically shown part of the supporting structure 10' in FIG. 8 and the arrangement of shearing plates 13', 14' for absorption of vertical and horizontal forces, respectively. In this embodiment there is provided a curved plate 67 following the outer edge of the supporting structure 10', and thereby constituting the force-transferring connection between the supporting structure and the shearing plates 13'. The curved plate is assembled with the supporting structure before the installation on the hull of the ship 1, so that the connection can be rapidly assembled. As suggested, there are provided a pair of inclined struts 68 contributing substantially to reducing the moment action in the connection between the hull and the shearing connections 13', 14'.

As mentioned above, the connections of the column with the rotating body and the rotating table may be carried out in many different ways. The solutions described above only constitute examples of how to achieve the preferred properties of the connections, viz. axial rigidity in the axial support of the column, axial suppleness in the radial connection, so that axial relative movements can take place, radial rigidity in the radial plane, and rotational freedom out of the plane, both in tension and in compression.

What is claimed is.:

1. A rotating tower system for transferring hydrocarbons to a ship, comprising a transfer structure extending from a bottom of the ship to a deck thereof, the structure at its lower end being connected to a number of risers and to anchor lines for anchoring of the ship, and at its upper end being connected to a rotatable coupling device on the deck of the ship, the structure comprising a lower and an upper rotating body which are independently mounted in relation to the ship and are connected to each other via an intermediate connecting unit, wherein the lower and upper rotating bodies in their central regions are connected to a lower and an upper end, respectively, of the connecting unit via articulated bearing connections allowing occurring angular deviations and also absorbing radial and/or axial forces.

2. A rotating tower system according to claim 1, wherein the connecting unit is a hollow column giving room for risers and guide pipes for umbilicals.

3. A rotating tower system according to claim 2, wherein the connecting unit at its lower end has a transition portion passing into a cylindrical tube member which is coupled to the lower rotating body via a static bearing, the tube member with a clearance surrounding an elongated structural member which is supported at its lower end by a base in the lower rotating body and at its upper end is supported by a supporting structure in the column.

4. A rotating tower system according to claim 3, wherein the bearing is fitted in a bearing box which is fixed in the lower rotating body, the tube member being rotationally fixedly connected to the bearing box.

5. A rotating tower system according to claim 4, wherein the rotationally fixed connection is provided in that the lower end of the tube member is formed with a number of axially directed teeth which are in engagement with complementary teeth arranged in the bearing box.

6. A rotating tower system according to claim 3, wherein the static bearing is made of an elastomeric material.

7. A rotating tower system according to claim 2, wherein the connecting unit at its lower end has a transition portion passing into a slender structural member having a lower end which is supported by a base in the lower rotating body, and having an upper end which is supported in the lower rotating body by means of a radial bearing.

8. A rotating tower system according to claim 2, wherein the connecting unit at its upper end passes into a stud which is mounted in a radial bearing fitted centrally in the upper rotating body.

9. A rotating tower system according to claim 8, wherein the upper rotating body is mounted in a bearing means arranged at the same level as the bearing for the upper stud of the connecting unit.

10. A rotating tower system according to claim 1, wherein the system is arranged on the outer side of the ship, the a bearing means for the upper and lower rotating bodies being arranged in supporting structures which are rigidly connected to a ship side via respective vertical and horizontal shearing plates.

* * * * *